United States Patent [19]

Haruyama et al.

[11] Patent Number: 4,945,732

[45] Date of Patent: Aug. 7, 1990

[54] REFRIGERATED DISPLAY CASE WITH A DAMPER CONTROLLED DEFROSTING MECHANISM

[75] Inventors: Yasuto Haruyama; Hirokazu Akabane; Fumio Fukasawa, all of Gunma, Japan

[73] Assignee: Sanden Corporation, Gunma, Japan

[21] Appl. No.: 329,835

[22] Filed: Mar. 28, 1989

[30] Foreign Application Priority Data

Mar. 28, 1988 [JP] Japan ..... 63-40700[U]

[51] Int. Cl.[5] ..... A47F 3/04

[52] U.S. Cl. ..... 62/256; 62/234

[58] Field of Search ..... 62/151, 255, 256, 234

[56] References Cited

U.S. PATENT DOCUMENTS

| | | | |
|---|---|---|---|
| 2,960,844 | 11/1960 | Quick | 62/256 X |
| 3,094,851 | 6/1963 | Beckwith | 62/256 |
| 3,122,892 | 3/1964 | Beckwith . | |
| 3,499,295 | 3/1970 | Brennan | 62/81 |
| 4,148,197 | 4/1979 | Karashima | 62/256 |
| 4,633,677 | 1/1987 | Maehara | 62/256 |
| 4,644,758 | 2/1987 | Maehara et al. | 62/234 |
| 4,648,247 | 3/1987 | Takizawa et al. | 62/256 |
| 4,691,527 | 9/1987 | Ikeda | 62/234 |
| 4,741,171 | 5/1988 | Toshiyuki | 62/234 |
| 4,744,611 | 5/1988 | Tamura et al. | 312/116 |
| 4,807,446 | 2/1989 | Sunaga | 62/256 |

*Primary Examiner*—Lloyd L. King

*Attorney, Agent, or Firm*—Banner, Birch, McKie & Beckett

[57] ABSTRACT

A refrigerated display case is disclosed which has an interior cabinet and an exterior member. A refrigerating circuit includes evaporators for refrigerating and heaters for defrosting a frost accumulated on the evaporators located forwardly of the evaporators. A circulating mechanism forces air into contact with the refrigerating circuit. A passage directs the refrigerated air. The display case is defined by a front opening for access to the interior thereof. At least two air inlets and corresponding outlets extend across opposed edges of said front opening. The passage includes at least inner and outer conduits which communicate with the respective outlets and inlets, the passage being defined between the interior cabinet and the exterior member. A circulating mechanism operates to drive separate air steams through the passage and across the front opening in an innermost stream and an outermost stream. The refrigerating mechanism is located in the inner conduit for refrigerating the innermost stream crossing the access opening. The damper mechanism merges the air stream which passes through the outer conduit into the inner conduit during operation of a defrosting mode. Therefore, the time for defrosting of evaporators can be shortened.

9 Claims, 4 Drawing Sheets

REFRIGERATED DISPLAY CASE WITH A DAMPER CONTROLLED DEFROSTING MECHANISM

TECHNICAL FIELD

This invention relates to a refrigerated display case, and more particularly, to a defrosting mechanism utilized in a refrigerated display case.

BACKGROUND OF THE INVENTION

Refrigerated display cases which have a front opening for shopping convenience are well known in the art. As shown in FIG. 1, refrigerated display case 2 includes exterior member 3 and interior cabinet 4 between which outer conduit 3*a* and inner conduit 4*a* are formed. A refrigerating means, evaporator 5 and fan 6, is located within inner conduit 4*a* for refrigerating the air flow therethrough. Outlet ports 3*b* and 4*b* of outer and inner conduits 3*a* and 4*a* respectively are disposed on the upper side of the front opening and inlet ports 3*c* and 4*c* are disposed on the lower side of the front opening.

When refrigerated display case 2 starts to operate, the air flow through inlet port 4*c* is refrigerated by evaporator 5 and is continuously circulated through inner conduit 4*a*, outlet port 4*b* and inlet port 4*c*. Likewise, the normal temperature air flow through inlet port 3*c* is divided into two air flows at the bottom portion of the case 2 in outer conduit 3*a*. The two air flows merge at the upper portion of conduit 3*a*, and air is discharged through outlet port 3*b*. Accordingly, the refrigerated space in display case 2 is isolated from the ambient atmosphere by a double air curtain. Foods on shelves 7 in display case 1 are refrigerated and preserved in refrigerated condition by the double air curtain.

In this type of refrigerated display case 2, the inner curtain passage 4*a* and the refrigerating means must be frequently defrosted to remove any accumulated frost on the evaporator collected from the cooled air so that the frost does not imede the operation of the equipment. Such a defrosting operation in display case 2 is achieved by the use of electrical heater 8 located in front of evaporator 5 of the refrigerating means. Through defrosting by means of the electrical heater, the refrigerating mechanism is temporarily heated while allowing the air to continue to circulate through the two air curtains. Thus, the circulating air flowing through inner conduit 4*a* is warmed by heating of electrical heater 8. The warm air can then melt the frost built up on evaporator 5. At the same time, the exterior curtain is maintained. It is important to melt this frost as rapidly as possible, in order to minimize any rise in temperature of the refrigerated foods and to minimize collection of frost and the refrigerated foods from the higher humidity of the recirculated warm air.

SUMMARY OF THE INVENTION

It is a primary object of this invention to provide an improved refrigerated display case which has a more effective defrosting mechanism.

It is another object of this invention to provide an improved refrigerated display case which can accomplish defrosting in a shorter time.

It is a further object of this invention to provide an improved refrigerated display case which is easily adapted for installation in existing refrigerated display cases with only minor modifications to such cases.

A refrigerated display case according to the present invention has an interior cabinet and an exterior member. A refrigerating circuit includes evaporators for refrigerating and heaters for defrosting the evaporators, the heaters being located forwardly of the evaporators so as to heat air approaching the evaporators. A circulating mechanism forces air into contact with the refrigerating circuit. A passage directs the refrigerated air. The case defines a front opening for access to the interior thereof. At least two air inlets and corresponding outlets extend across opposed edges of said front opening. The air passage includes at least inner and outer conduits which communicate with the respective outlets and inlets, the air passage being defined between the interior cabinet and the exterior member. A circulating mechanism operates to drive separate air streams through the passage and across the front opening in an innermost stream and an outermost stream. The refrigerating mechanism is located in the inner conduit for refrigerating the innermost stream crossing the access opening. According to the principles of the present invention, a damper mechanism is provided for merging the air stream which passes through the outer conduit into the inner conduit during operation of a defrosting mode.

Further objects, features and other aspects of the present invention will be understood from the following detailed description of the preferred embodiments with reference to the attached drawings.

DETAILED DESCRIPTION OF THE PREFERRED EMBODIMENTS

Figure 1:
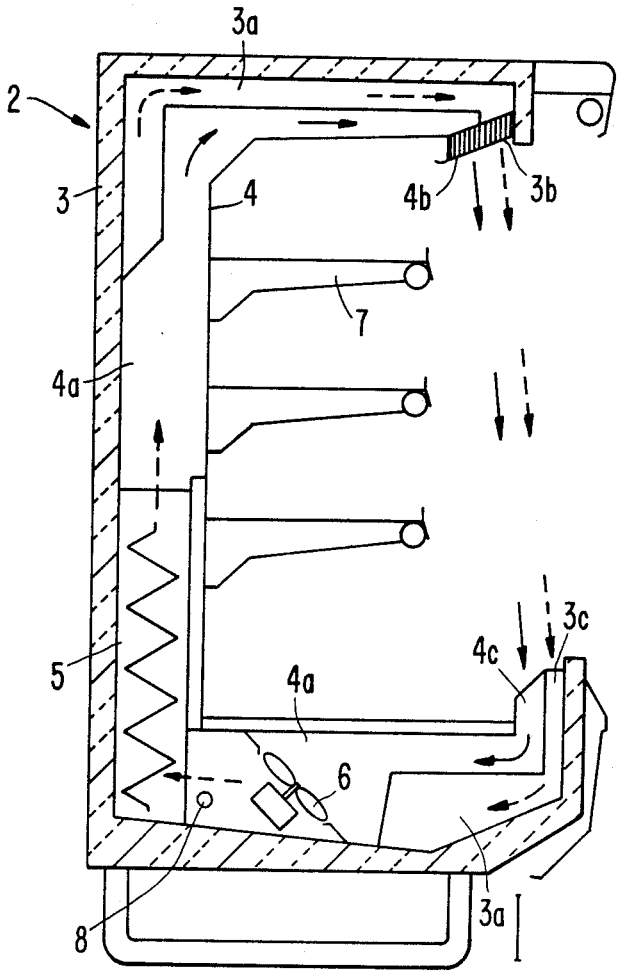
FIG. 1. (PRIOR ART)
FIG. 1 is a sectional view of a conventional refrigerated display case.
Figure 2:
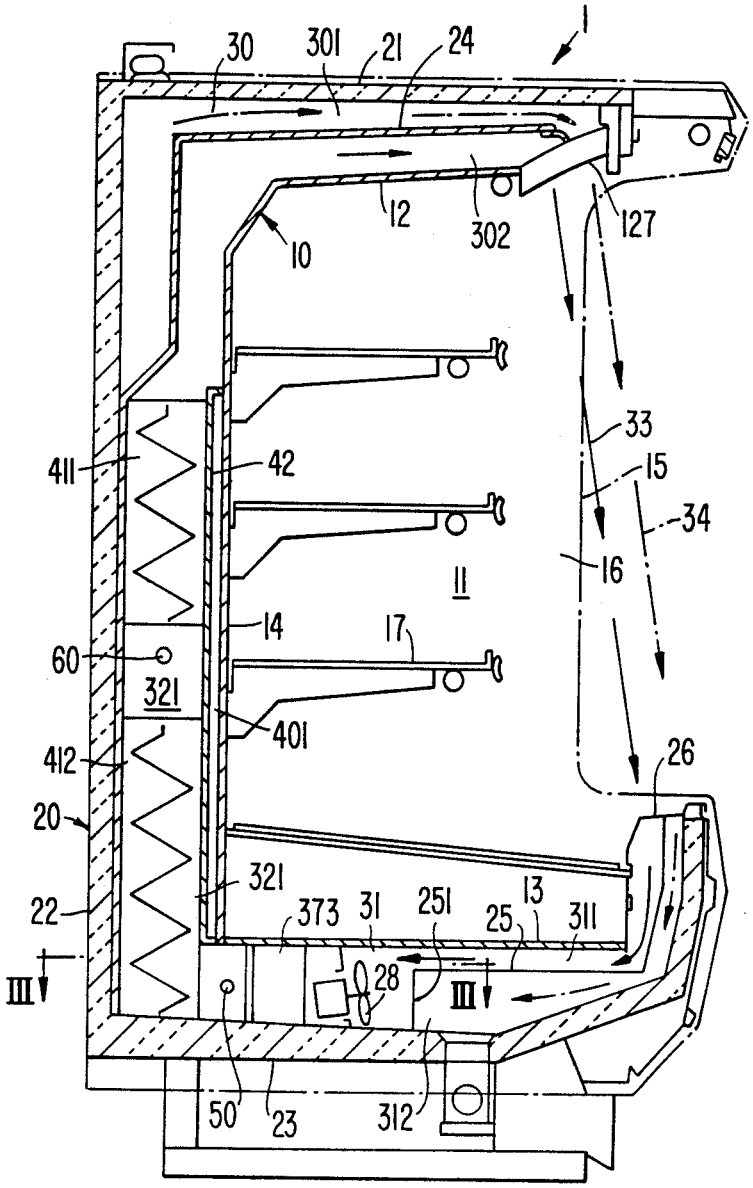
FIG. 2 is a sectional view of a refrigerated display case in accordance with one embodiment of this invention.
Figure 3:
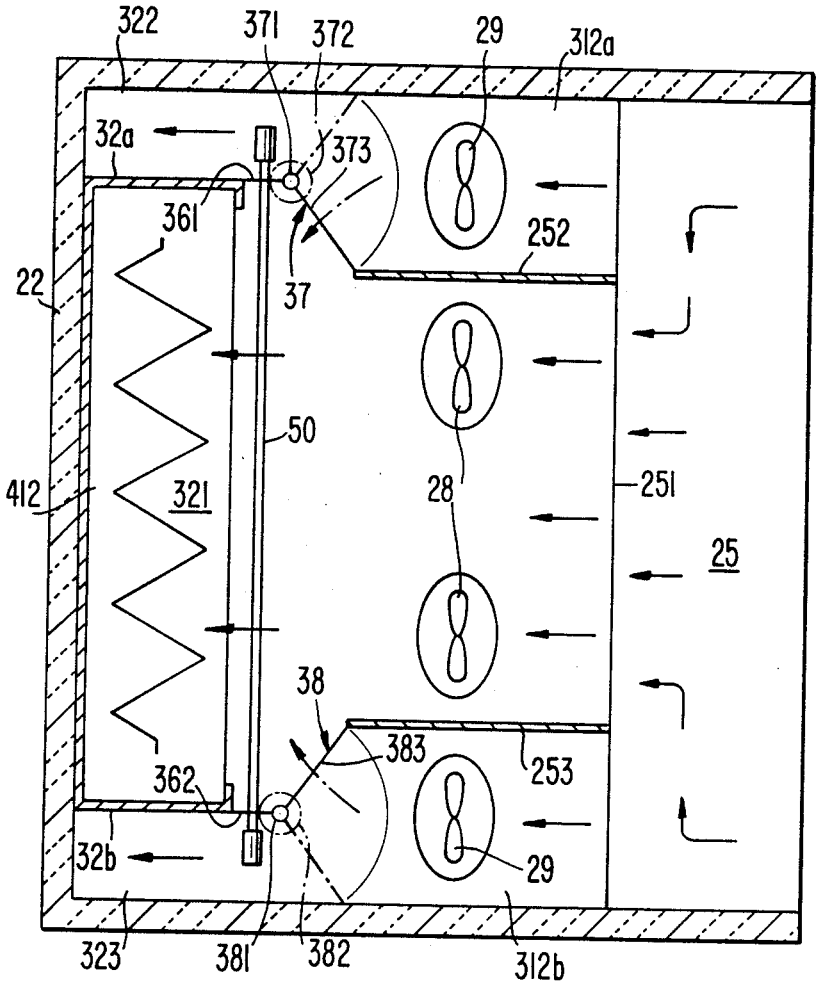
FIG. 3 is an enlarged cross-sectional view taken along line III—III as shown in FIG. 2.

Referring to FIGS. 2 and 3, a refrigerated display case 1 in accordance with one embodiment of this invention is shown. The refrigerated display case 1 comprises interior cabinet 10 with display space 11 and an exterior cabinet 20. Interior cabinet 10 is defined by upper panel 12, bottom panel 13 and rear panel 14 extending upwardly between the upper and bottom panels 12 and 13. Display space 11 is bounded on the side by a pair of side wall panels (only one side panel 15 is indicated in FIGS. 1 and 2 by a dot dash line). Display space 11 has front opening 16 at its front side to easily access the interior of display space 11 from the ambient atmosphere. Furthermore, display space 11 is divided into sections by a plurality of vertically spaced, generally horizontal shelves 17 which are mounted, preferably adjustably, on suitable uprights at rear panel 14.

Exterior cabinet 20 of case 1 is defined by top member 21, vertical rear wall 22 and bottom member 23, each of which is usually formed of an insulation material. The space between the panels of interior cabinet 10 and exterior cabinet 20 forms a plurality of air flow passages which define multiple air curtains. In the space between top member 21 and upper panel 12, is disposed upper divider panel 24 which horizontally divides space 30, i.e., upper space 30 is divided into two passage spaces, upper passage space 301 and lower paassage space 302. Bottom space 31 between bottom paanel 13 and bottom member 23 is also horizontally divided into two chambers or passage spaced by first lower divider panel 25, i.e., upper passage space 311 and lower passage space 312. Referring to FIG. 3, lower passage space 312 is vertically divided into two passage spaces **312*a* and 312*b* by second lower divider panels 251, 252 and 253**.

Space 32 formed between rear panel 14 and vertical rear wall 22 is vertically divided by two separator plates **32*a* and 32*b* to form three passage spaces or conduits which are transversely parallel with one another. Center passage 321 of the three passages, in which a refrigerating unit is disposed, is connected with lower passage space 302 of upper space 30 and upper passage space 311 of bottom space 31 to form a first air circulating passage. Both of side passages 322 and 323 of the three passages are connected with upper space 30 and lower passage space 312 of bottom space 31 to form a second air circulating passage. Air inlets 26 are provided for each of the air circulating passages. Streams 33 and 34 which cross front opening 16 of display space 11, pass into these inlets 26 and are driven through the passages to outlets 27 which are formed at the discharge opening of upper space 30, thus forming a clockwise circulation path as shown in FIG. 2** by the solid and dot and dash line arrows.

As mentioned above, the first air circulating passage is formed around display space 11, and the refrigerated air flowing through the first air circulating passage forms an enclosing air curtain across the front opening 16 of display space 11. The second air circulating passage is defined by the outer positioned passage spaces of the upper and bottom spaces and rear space 32. The inlet and outlet of the second air circulating passage are placed adjacent to an outwardly of the inlet and outlet of the first air circulating passage to form second air stream 34. During normal refrigerating operation, air is circulated through the first and second air circulating passages by a plurality of motor operated fans 28 and 29 disposed in bottom space 31. Fans 28 cause an air circulation through the first air circulating passage and fans 29 cause an air circulation through the second air circulating passage. The temperature of the air passed through the second air circulating passage is slightly higher than the temperature of the air passed through the first air circulating passage, but below the temperature of the ambient atmosphere. Therefore, the air curtain created by the second air circulating passage protects the air temperature of the first air circulating passage from reduction.

Evaporators 411 and 412 are disposed in the way of center passage 321 so as to be vertically aligned with each other. Electric heaters 50 and 60 are disposed in front of evaporators 411 and 412, respectively, for heating the air passage through center passage 321 thereby defrosting any frost accumulated on evaporators 411 and 412. Supporting plates 361 and 362 are respectively attached on both side end surfaces of evaporator 412 at its bottom, which is formed in an L-shape. Damper mechanisms 37 and 38, which include supporting axes 371 and 381, drive motors 372 and 382 and damper plates 373 and 383, are connected with supporting plates 361 and 362, respectively, at their front ends. The ends of damper plates 373 and 383 usually contact second lower divider panels 252 and 253 to form separate passage spaces **312*a* and 312*b*, i.e., lower passage space 312 from upper passage space 311. Damper plates 373 and 383 rotate around supporting axes 371 and 381 respectively when driven with drive motors 372 and 382, respectively, in response to a predetermined desirable angle. For an alternate drive mechanism for rotating damper plates 373 and 383, a solenoid and an actuator may be applied. Likewise, a link mechanism may be used to link the damper plates so that both damper plates 373 and 383** can be rotated with one drive motor.

During operation of a refrigerating cycle in the display case 1, the normal temperature air, i.e., second air circulating passage, circulates within lower passage space 312, side passages 322 and 323 and upper passage space 301. When the refrigerating cycle is changed to a defrosting mode, electric current is supplied to both electric heaters 50 and 60. Simultaneously, damper plates 372 and 382 rotate around supporting axes 371 and 381 until the position of the dashed line when driven with drive motors 373 and 383, respectively. Accordingly, the communication between side passages 322 and 323, and lower passage space 312 is obstructed by damper plates 372 and 382, thereby changing the direction of the air flow in the second air circulating passage to the center passage 321. The second air circulating passage merges into the first air circulating passage containing electric heater 50. The volume of the first air circulating passage is thus increased. The temperature of the conducted air is also increased because of the merging of the large volume of room temperature air. The large volume and reatively high temperature of the air is heated by electric heaters 50 and 60, and the time of defrosting of evaporators 411 and 412 is correspondingly shortened.

Figure 4:
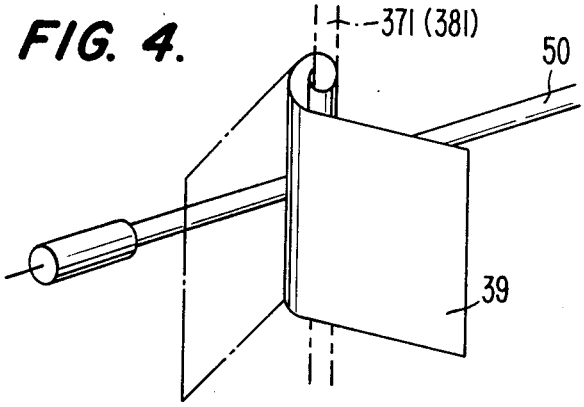
FIG. 4 is a perspective view of a damper in accordance with another embodiment of this invention.

Referring to FIG. 4, a damper mechanism in accordance with a second embodiment of this invention is shown. Damper plate 39, which is made of shape-memory alloy, is fixedly attached to the circumference of supporting axes 371 and 381 at its one end and disposed to contact electric heater 50. When electric current is supplied to electric heater 312 and electric heater 312 starts to generate heat, damper plate 39 rotates and moves until the position of a dash, double dotted line in response to the generation of heat of electric heater 50 in passage 312. Accordingly, the second air circulating passage merges into first air circulating passage as mentioned above. In this embodiment, the drive mechanism, motors, solenoids and actuators, etc, can be omitted.

Damper mechanisms 37, 38 and 39 are not defined at the position as shown in the above embodiments. It can be equally advantageous to dispose damper mechanism 37, 38 and 39 at the upper side of evaporator 412. Furthermore, the other position can be advantageous if the second air circulating passage can be merged into the first air circulating passage.

This invention has been described in detail in connection with a preferred embodiment, but this embodiment is an example only and the invention is not restricted thereto. It will be easily understood by those skilled in the art that other variations and modifications can be easily made within the scope of the appended claims.

We claim:

1. In a refrigerated display case having an interior cabinet and an exterior member, including a refrigerating means including evaporator means, heater means for defrosting of said evaporator means located forwardly of said evaporator means, a circulating means for forcing air into contact with said refrigerating means, and a passage means for directing the refrigerated air, said case having a front opening for access to the interior thereof, at least two air inlets and corresponding outlets extending across opposed edges of said front opening, said passage means including at least inner and outer conduits communicating with the respective outlets and inlets and being defined between said interior cabinet and said exterior member, said circulating means operating to drive separate air streams through said passage means and across said front opening in an innermost stream and an outermost stream, and said refrigerating means being located wholly within said inner conduit for refrigerating the innermost stream crossing said access opening, the improvement comprising:

damper means for merging said air stream passing through said outer conduit into said inner conduit during operation of a defrosting mode, said damper means comprising at least one damper plate positioned in advance of said refrigerating means, said damper means for directing the air to flow smoothly from the outer conduit to the inner conduit containing the refrigerating means.

2. The refrigerated display case of claim 1 wherein said damper means is disposed along divider plates for separating said inner and outer conduits.

3. The refrigerated display case of claim 1 wherein said damper means includes a second damper plate and a driving means for operating said damper plate.

4. The refrigerated display case of claim 2 wherein said damper means includes a second damper plate and a driving means for creating said damper plate.

5. The refrigerated display case of claim 2 wherein said damper means comprises shape-memory alloy and is located proximate to the heater means.

6. The refrigerated display case of claim 1 wherein said evaporator means comprises plural evaporators.

7. The refrigerated display case of claim 1 wherein the damper means is positioned between said circulating means and said refrigerating means inlet.

8. In a refrigerated display case having an interior cabinet and an exterior member, including a refrigerating means including evaporator means, heater means for defrosting of said evaporator means located forwardly of said evaporator means, a circulating means for forcing air into contact with said refrigerating means, and a passage means for directing the refrigerated air, said case having a front opening for access to the interior thereof, at least two air inlets and corresponding outlets extending across opposed edges of said front opening, said passage means including at least inner and outer conduits communicating with the respective outlets and inlets and being defined between said interior cabinet and said exterior member, said circulating means operating to drive separate air streams through said passage means and across said front opening in an innermost stream and an outermost stream, and said refrigerating means being located in said inner conduit for refrigerating the innermost stream cross said access opening, the improvement comprising:

damper means comprising a shape-memory alloy and located proximate to said heater means, said damper means for merging said air stream passing through said outer conduit into said inner conduit during operation of a defrost mode.

9. In a refrigerated display case having an interior cabinet and an exterior member, including a refrigerating means including evaporator means, heater means for defrosting of said evaporator means located forwardly of said evaporator means, a circulating means for forcing air into contact with said refrigerating means, and a passage means for directing the refrigerated air, said case having a front opening for access to the interior thereof, at least two air inlets and corresponding outlets extending across opposed edges of said front opening, said passage means including at least inner and outer conduits communicating with the respective outlets and inlets and being defined between said interior cabinet and said exterior member, said circulating means operating to drive separate air streams through said passage means and across said front opening in an innermost stream and an outermost stream, and said refrigerating means being located wholly within said inner conduit for refrigerating the innermost stream crossing said access opening, the improvement comprising:

damper means for merging said air stream passing through said outer conduit into said inner conduit, and said inner and outer conduits having portions formed in the same plane and horizontal to said front opening.

* * * * *